United States Patent [19]

Eng

[11] Patent Number: 4,919,036

[45] Date of Patent: Apr. 24, 1990

[54] ARRESTING APPARATUS FOR FIXATION OF AN ADJUSTED POSITION

[75] Inventor: Peter Eng, Regensdorf, Switzerland

[73] Assignee: Contraves AG, Zürich, Switzerland

[21] Appl. No.: 267,832

[22] Filed: Nov. 7, 1988

[30] Foreign Application Priority Data

Nov. 10, 1987 [CH] Switzerland ..... 04369/87

[51] Int. Cl.[5] ..... F41D 11/06

[52] U.S. Cl. ..... 89/37.11; 74/556

[58] Field of Search ..... 89/37.11; 292/306; 403/351, 350, 87; 285/413; 74/536, 556, 557

[56] References Cited

U.S. PATENT DOCUMENTS

| | | | |
|---|---|---|---|
| 1,252,362 | 1/1918 | Mueller | 74/556 |
| 1,449,563 | 3/1923 | Vincent | 74/556 |
| 1,555,599 | 9/1925 | Ontiveros | 74/557 |
| 1,832,805 | 11/1931 | Brewster | 74/557 |
| 2,123,811 | 7/1938 | Sinko | 74/557 |
| 2,281,556 | 5/1942 | Chase et al. | 89/37.11 |
| 2,476,195 | 7/1949 | Horman | 74/536 |
| 3,244,076 | 4/1966 | Wey | 89/37.11 |
| 4,018,104 | 4/1977 | Bland et al. | 74/531 |

FOREIGN PATENT DOCUMENTS

| | | | |
|---|---|---|---|
| 229089 | 5/1959 | Australia | 74/557 |
| 300196 | 2/1920 | Fed. Rep. of Germany . | |
| 2041447 | 4/1971 | Fed. Rep. of Germany | 292/306 |
| 2484627 | 7/1981 | France | 89/37.11 |
| 300430 | 9/1932 | Italy | 89/37.11 |
| 281164 | 2/1952 | Switzerland . | |
| 10639 | of 1908 | United Kingdom | 89/37.11 |
| 5371 | of 1910 | United Kingdom | 89/37.11 |
| 27193 | of 1911 | United Kingdom | 74/557 |

*Primary Examiner*—Charles T. Jordan
*Assistant Examiner*—Stephen Johnson
*Attorney, Agent, or Firm*—Werner W. Kleeman

[57] ABSTRACT

To order to positively lock or arrest an adjusted position at a mechanical device, for instance the elevation position at a firing device, with negligible play, wherein there is fixed the position set by a hand wheel serving for adjustment of the elevation position of the firing device, there is provided a locking or arresting apparatus comprising a clamping device arranged at a stationary part or housing of the firing device. The clamping device comprises two jaw members. By means of the clamping device, following setting of the desired position, such as the elevation position of the firing device, a ring member fixedly connected with the rotatably mounted hand wheel can be clamped between both clamping jaw members by the clamping device. In this way, the ring member can be positively arrested or fixed in position. The locking or arresting apparatus has many fields of application for all types of mechanical devices of different construction.

11 Claims, 3 Drawing Sheets

ARRESTING APPARATUS FOR FIXATION OF AN ADJUSTED POSITION

BACKGROUND OF THE INVENTION

The present invention broadly relates to a new and improved construction of a locking or arresting apparatus for securing or fixing an adjusted or set position at an associated device or apparatus, for instance an adjusted position at a mechanical device which is pivotably mounted upon a support. Moreover, for adjusting and fixing the previously adjusted position, there can be, for instance, locked or arrested a rotatably mounted operating member in the form of a hand wheel which is operatively connected by means of a gearing or transmission with the mechanical device.

The prior art is acquainted with arrangements and constructions of locking or arresting apparatuses for securing an aligned position, in other words, an adjusted position of a firing weapon. However, heretofore it was still problematic to achieve at the firing weapon an infinite securement or locking of the adjusted position free of play and which was effective in both directions of adjustment of the firing weapon.

A firing device, as such is constituted by a firing weapon or gun, should be capable of being locked or arrested in random infinite elevation positions or settings of the firing weapon with simple operations performed by the gunner or operator. In this case, the adjustment or setting operation which is involved concerns the alignment of the optical sighting line with respect to the bore axis of the firing weapon. In order to accomplish these difficult or sensitive adjustment operations, there must be capable of being carried out a locking or arresting operation which is precise and free of play, in other words, a positively effective locking or arresting operation. Additionally, the locking or arresting operation must be completely effective in both directions of rotation in the manual drive, such as the hand wheel. In the released position of the hand wheel, there must be ensured a frictionless free-wheeling of the hand wheel.

However, due to the special requirements which are placed upon the performance of a locking or arresting operation, there arise further problems to the extent that when resorting to manual operation the elevation angle is increased in relation to N (revolutions or turns of the hand wheel) $\times$ 360°. Also, the bearings should not be loaded by the arresting or locking operation. In other words, there must be accomplished a stress-free locking or arresting operation. Moreover, the operation itself preferably must occur by performing a rotational movement having constant torque or moment of rotation throughout the entire free-wheeling action of the hand wheel.

It is already known in this technology to arrange, for instance, a lamellae-brake between a stationary immobile part of the firing device, such as for example a gun mount or a housing, and a rotatably mounted hand wheel. By means of the lamellae-brake it is intended to lock and fix in place the position of the hand wheel and thus the momentarily set adjusted position of the firing device. The heretofore known arrangement of a lamellae-brake for locking or arresting a once-set adjusted position at a firing device was, however, not satisfactory. Additionally, the constructional expenditure and space requirements for the prior art arrangement of a lamellae-brake were comparatively high. When there is subsequently installed or retrofitted a locking or arresting apparatus, there can particularly arise considerable problems as concerns space requirements and it is for this reason that constructional solutions having modest or small space requirements are advantageous.

SUMMARY OF THE INVENTION

Therefore with the foregoing in mind it is a primary object of the present invention to provide a new and improved construction of a locking or arresting apparatus of the character described which does not suffer from the aforementioned drawbacks and shortcomings of the prior art constructions.

Another and more specific object of the present invention aims at the provision of a new and improved construction of a locking or arresting apparatus for securing a set or adjusted position at a mechanical device, by means of which there can be avoided in particular the previously discussed drawbacks which prevail at the heretofore known locking or arresting apparatuses which are arranged at firing devices or weapon systems.

Yet a further noteworthy object of the present invention, is directed to an improved construction of a locking or arresting apparatus of the character described which is essentially free of maintenance requirements and is operationally reliable to an exceedingly great degree and wherein such locking or arresting apparatus also can be beneficially employed at relatively inaccessible or not readily accessible locations.

A further significant object of the present invention is directed to the provision of a new and improved construction of locking or arresting apparatus for reliably and positively fixing a set position at an associated device, typically although not exclusively for instance a firing weapon, which apparatus is relatively simple in construction and design, exceedingly reliable in operation, not readily subject to malfunction, and requires virtually no maintenance or servicing.

Now in order to implement these and still further objects of the invention, which will become more readily apparent as the description proceeds, the locking or arresting apparatus of the present development, among other things, is manifested by the features that an adjustment mechanism, for instance in the form of a substantially plate-shaped or disc-shaped hand wheel is provided with a substantially cylindrical-shaped ring member or annulus. This substantially cylindrical-shaped ring member or annulus is fixedly connected with the hand wheel and is arranged concentrically with respect to an axis of rotation of the adjustment mechanism. A respective clamping jaw or jaw member is arranged at each of two curved or curviform sides of the substantially cylindrical-shaped ring member or annulus. These clamping jaw members constitute components of a self-adjusting clamping device which is fixedly connected with a housing of the associated device and is displaceable with respect to the ring member of annulus.

According to a preferred construction, there is provided at the housing of the associated device, such as the firing device, a recess or cavity for the reception of an insert member or insert which is fixedly connected with the housing. The clamping device possessing the two clamping jaw members or jaws is arranged in this insert member. Additionally, the insert member is advantageously arranged at the vicinity of the outer surface of circumference of the hand wheel at a radial spacing from the axis of rotation thereof and within the recess or cavity of the aforementioned housing.

Both of the clamping jaw members of the clamping device, are guided in a substantially U-shaped recess or opening for to-and-fro or reciprocal movement, as viewed in the lengthwise direction of the substantially U-shaped recess. The clamping jaw members are guided in the substantially U-shaped recess or opening in such a manner that these clamping jaw members cannot perform any movement in lateral direction.

According to a further advantageous design of the locking or arresting apparatus of the present development, the clamping jaw member which is arranged at the outer side of the ring member or annulus possesses a concave domed or arched contact- or press surface which is accommodated to the outer circumference or outer surface of the ring member or annulus. Moreover, the clamping jaw member which is arranged at the inner side or inner surface of the ring member or annulus contains a convex domed or arched contact or press surface which is accommodated to the inner circumference or inner surface of the ring member or annulus.

In a preferred design of the inventive locking or arresting apparatus the clamping device comprises an actuation or actuating shaft or shaft member which is rotatably mounted at friction or slide bearings. This actuation shaft is in drive connection with an electric or manually operatable device in order to selectively impart to the actuation shaft a rotation in both possible directions of rotation. Furthermore, the actuation shaft comprises a cylindrical shaft portion or section having external thread or threading which engages with an internal thread or threading of the one clamping jaw member which is operatively associated with the inner side or inner surface of the ring member or annulus. Moreover, the actuation shaft is piercingly guided through a bore of the other clamping jaw member which is operatively associated with the outer side or outer surface of the ring member.

As viewed or considered with respect to the clamping jaw member which is mounted upon the actuation shaft and which is operatively associated with the outer side or outer surface of the ring member, there are mounted upon such actuation shaft plate springs, a support ring or ring member for the plate springs and a bushing or sleeve which is fixedly connected with the actuation shaft.

At an end of the bushing or sleeve which protrudes past the insert member there is arranged a pin or pin member. This pin or pin member extends transversely or laterally of the bushing or sleeve and protrudes at one end of such pin past the circumference or outer surface of such bushing or sleeve. This protruding end of the pin carries out, within a circular or arcuate-shaped recess or opening of the insert member, a rotational movement in both possible directions of rotation throughout a predetermined angular range upon actuation of the clamping device. The angular range extends between a first stop or impact member and a second stop or impact member and these stops or impact members are arranged in the circular or arcuate-shaped recess or opening of the insert member.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
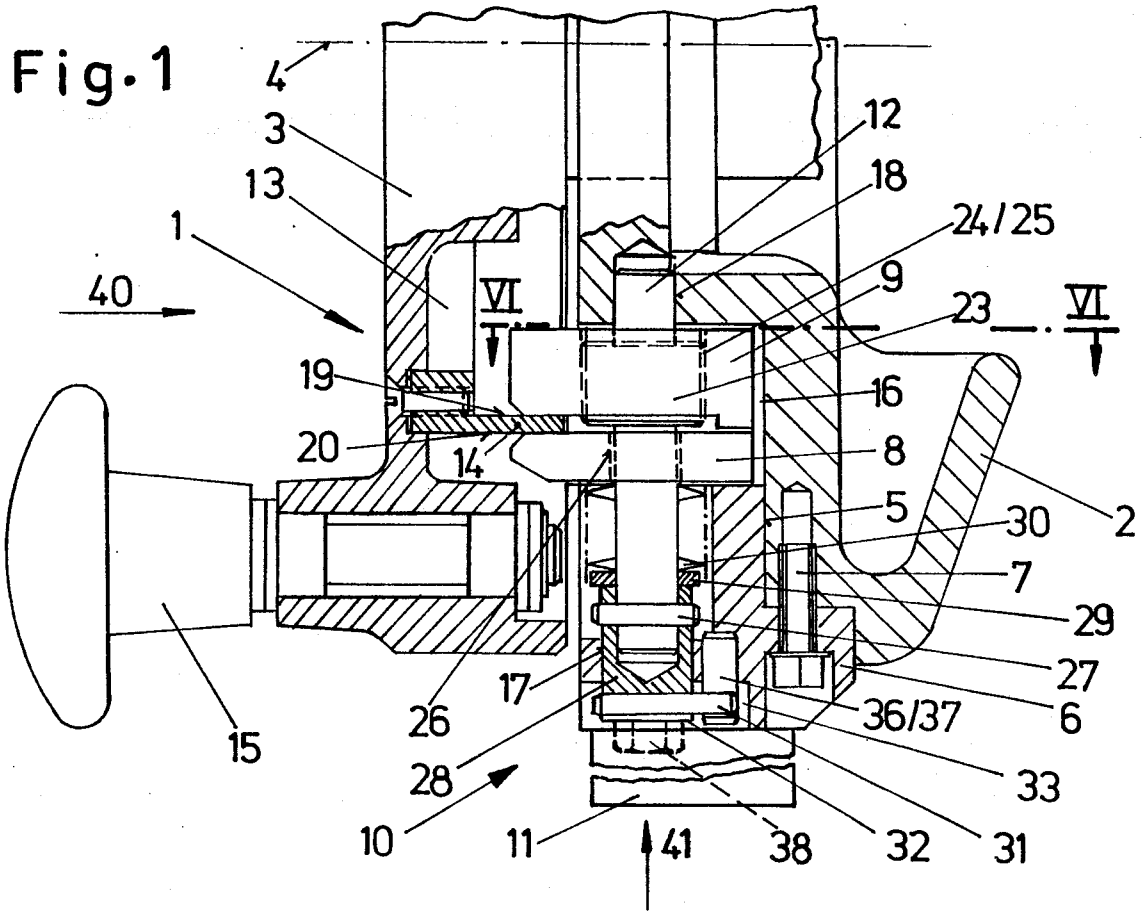
FIG. 1 is a fragmentary sectional view through an exemplary embodiment of a locking or arresting apparatus constructed according to the invention and serving for the locking or arresting of an adjustment or adjusting mechanism, here a hand wheel in relation to a stationary, immobile housing part or portion of an associated device, here a firing device or gun.
Figure 2:
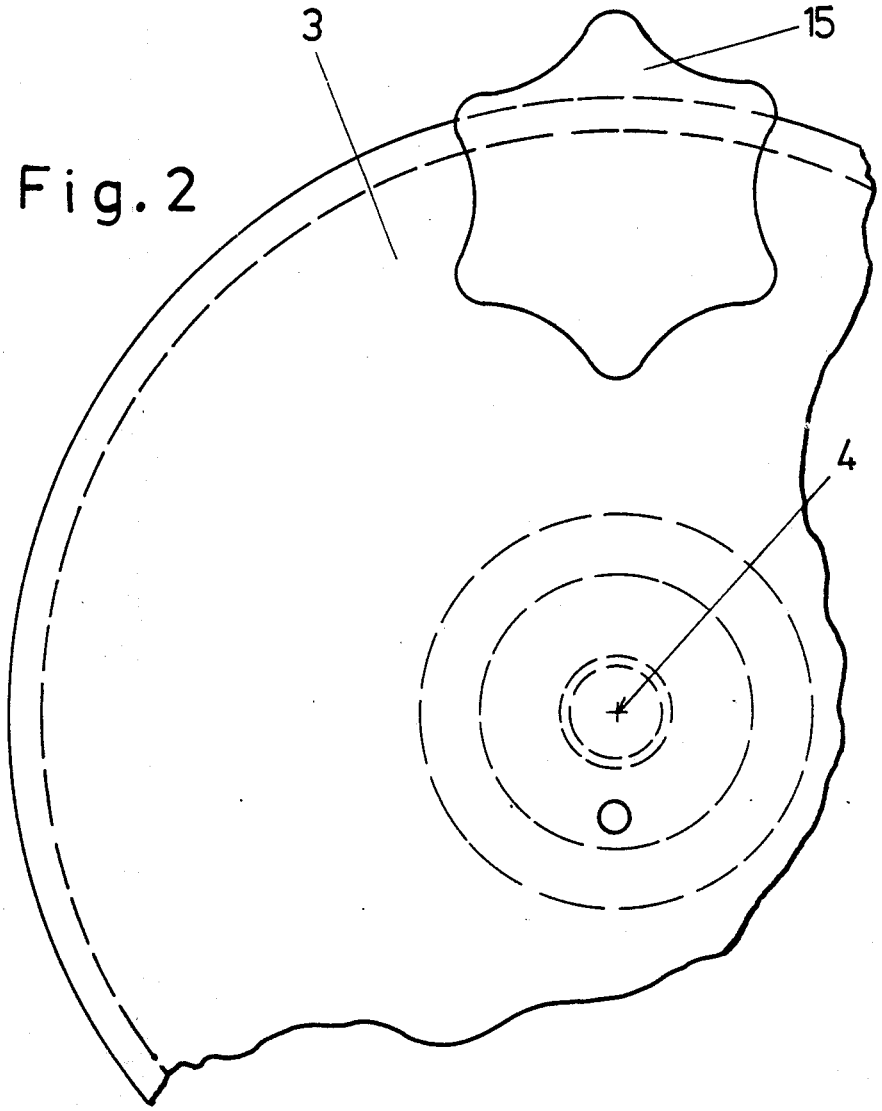
FIG. 2 is a fragmentary top plan view of the exemplary embodiment of locking or arresting apparatus depicted in Figure and looking generally in the direction of the arrow 40 thereof and from which there will be particularly apparent the circular or round plate-shaped or disc-shaped construction of the hand wheel.

Describing now the drawings, it is to be understood that to simplify the showing thereof, only enough of the construction of the locking or arresting apparatus and the related device, such as a firing device or gun, have been illustrated therein as is needed to enable one skilled in the art to readily understand the underlying principles and concepts of this invention. Turning attention now specifically to FIGS. 1 to 6 of the drawings, there has been depicted a locking or arresting apparatus 1 which is arranged at a not particularly depicted gun mount by means of a stationary housing part or housing 2 and at which a firing device, for instance a gun, is pivotably mounted for adjustment or setting of elevational positions or the elevation thereof. In order to set or adjust the elevational position, there is provided at the housing part or housing 2 an adjustment or adjusting mechanism here shown in the form of a hand wheel 3. This hand wheel 3 is rotatably mounted for rotational movement about an axis of rotation 4 at a bearing location of the housing part or housing 2. This hand wheel 3 is in appropriate drive connection with the firing device or gun by means of any suitable gearing or transmission provided with a pivot mechanism.

By means of the inventive locking or arresting apparatus 1, it is intended to accomplish for each elevation or elevational position of the firing device or gun a locking or arresting of the firing device in order to adjust or measure the entire firing arrangement or system or for loading ammunition or for accomplishing maintenance work in an advantageous elevation position of the firing device.

Continuing, it will be observed that the hand wheel 3 possesses a substantially plate-shaped or disc-shaped configuration and is provided at its inner side or surface with a substantially cylindrical or cylindrical-shaped ring member or annulus 14. This ring member or annulus 14 is fixedly connected with the inner surface of the substantially plate-shaped hand wheel 3 and is disposed essentially concentrically with respect to the axis of rotation 4 of such hand wheel 3. At both of the curved or curviform sides or faces 19 and 20 of the substantially cylindrical ring member or annulus 14 there are arranged the clamping jaw members or jaws 8 and 9 as will be described in greater detail hereinafter. These clamping jaw members 8 and 9 constitute components of a clamping device 10 which likewise will be discussed more fully hereinafter.

Furthermore, it will be recognized that at a predetermined radial spacing from the axis of rotation 4 of the hand wheel 3 there is provided in close proximity or at the immediate region of the outer surface or circumference of the hand wheel 3 at the housing or housing part 2, a recess or cavity 5. This recess or cavity 5 serves for the reception of an insert member or insert 6 which is fixedly connected with the housing or housing part 2 by means of the threaded bolts or screws 7 or equivalent fastening expedients. Within the insert member 6 there is arranged the clamping device 10 which comprises the two clamping jaw members or jaws 8 or 9, as best seen by referring to FIGS. 1 and 4.

The hand wheel 3 is provided at its inner side or surface with a substantially ring-shaped or annular recess or opening 13 which overlies or covers the clamping jaw members 8 and 9 of the clamping device 10. These clamping jaw members 8 and 9 protrude past the surface of the housing or housing part 2, as clearly shown in FIG. 1. At the outer side or surface of the hand wheel 3 there is provided in conventional manner a crank or crank device 15 or equivalent structure.

Figure 6:
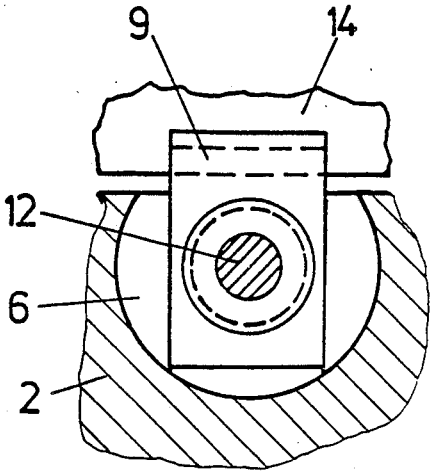
FIG. 6 is a fragmentary sectional view taken substantially along the line VI—VI of FIG. 1 of the locking or arresting apparatus shown in FIG. 1 for locking or arresting the hand wheel and from which illustration there will be particularly recognized the arrangement of the clamping jaw members in the housing part of the firing device.

As best seen by referring to FIGS. 1 and 6, both of the clamping jaw members 8 and 9 of the clamping device 10 are guided for to-and-fro or reciprocatory motion in a substantially U-shaped recess or opening 16 formed in the insert member 6 as viewed in the lengthwise direction of such recess or opening 16 such that the clamping jaw members or jaws 8 and 9 which respectively bear against the outer surface 20 and the inner surface 19 of the ring member 14 do not perform any motion in lateral direction. With the aid of the clamping device 10, these clamping jaw members 8 and 9 are respectively pressed against the outer surface 20 and the inner surface 19 of the ring member 14 and in this manner, are fixedly connected by friction with the ring member 14. It is here mentioned, that it also may be advantageous to provide a form-locking connection by appropriately constructing the clamping jaw members 8 and 9 and the substantially cylindrical-shaped ring member 14. One such possibility would be to apply a tooth structure, wherein, in that case however there would be foregone the infinite adjustability which is afforded when using a frictional connection. If the tooth structure is selected to constitute a relatively coarse tooth structure, then the latching positions can be used for one degree of adjustment; the use of a finer tooth structure would only serve to increase the locking or arresting force which is realized by virtue of the form-locking connection. Also the frictional connection can be increased by striving for specific pairings of materials. Such material pairings are possible to realize, for instance, by using adhesion liners or coverings at the clamping surfaces of the clamping jaw members 8 and 9 and/or at both of the curved sides or faces of the substantially cylindrical-shaped ring member or annulus 14.

Figure 4:
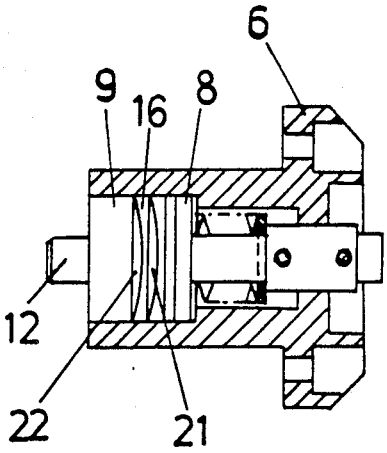
FIG. 4 is a longitudinal sectional view through the insert member arranged in the stationary immobile housing part of the firing device and depicting parts of the clamping device for actuating the clamping jaw members, the longitudinal sectional view being taken substantially along the line IV—IV of FIG. 3.

It is here further to be mentioned, and as will be particularly well recognized by inspecting FIG. 4, the clamping jaw member 8 arranged at the outer side or outer surface 20 of the ring member 14 possesses a concave domed or arched contact or press surface 21 which is accommodated to the outer circumference or outer surface 20 of the ring member 14. Moreover, the clamping jaw member 9 which is arranged at the inner side or inner surface 19 of the ring member 14 possesses a convex domed or arched contact or press surface 22 which is accommodated to the inner circumference or inner surface 19 of the ring member 14.

The previously discussed clamping device 10 comprises an actuation or actuating shaft member or shaft 12 which is rotatably mounted at slide or friction bearings 17 and 18 or equivalent bearing structure. This actuation shaft 12 is in drive connection with an electrically or manually operatable device 11 in such a manner that there can be selectively imparted to the actuation shaft 12 a rotation in clockwise direction and a different rotation in the opposite or counter-clockwise direction.

This actuation or actuating shaft 12 will be seen to comprise a substantially cylindrical shaft portion or section 23 provided with an external thread or threading 24 and which meshes with an internal thread or threading 25 arranged at the clamping jaw member 9. On the other hand, the other clamping jaw member 8 is provided with a through-bore or open-ended bore 26 through which there is piercingly guided the actuation shaft 12.

As will be readily recognized by focussing upon the clamping jaw member 8 which is mounted on or through which extends the actuation shaft 12, there are mounted upon such actuation shaft 12 plate springs or spring members 30, a support ring or ring member 29 for these plate springs 30 as well as a bushing or sleeve 28 which is fixedly connected non-rotatably with the actuation shaft 12 by means of a pin or pin member 27 or equivalent structure.

Figure 3:
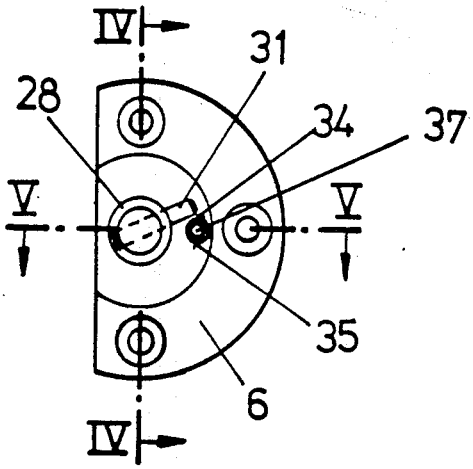
FIG. 3 is a side view of the locking or arresting apparatus as viewed when looking generally in the direction of the arrow 41 in FIG. 1, and wherein there will be particularly recognized a rotation limiting structure for the actuation or actuating shaft of the clamping device for actuating the clamping jaw members and which rotation limiting structure is arranged in an insert member of the housing of the associated device.
Figure 5:
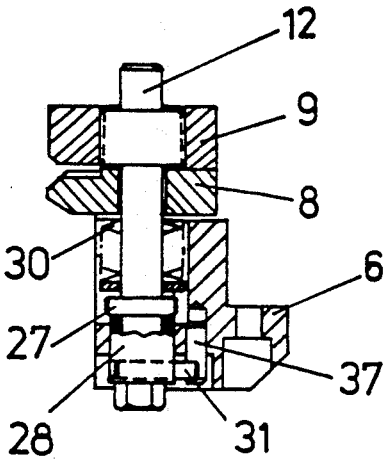
FIG. 5 is a longitudinal sectional view taken substantially along the line V—V of FIG. 3 through the insert member arranged in the stationary immobile housing part of the firing device, through the two clamping jaw members as well as through the clamping device located in the insert member and serving for actuating the clamping jaw members.

As will be seen by referring to FIGS. 3 and 5, at the end 32 of the bushing or sleeve 28 which protrudes out of the insert member 6 there is provided a pin or pin member 31. This pin or pin member 31 is arranged to extend transversely with respect to the bushing or sleeve 28 and protrudes beyond the outer circumference or outer surface of the bushing 28. Moreover, the pin or pin member 31 together with the protruding end 32 of the bushing 28 performs within the substantially circular or arcuate-shaped recess or opening 33 of the insert member 6 (see FIG. 1) a rotational or pivotal movement throughout a predetermined angular range upon actuation of the clamping device 10. This angular range, as will be seen from the illustration of FIG. 3, extends from a first stop or impact member 34 to a second stop or impact member 35. The first and second stop or impact members 34 and 35 are formed by a pin or pin member 37 which is arranged substantially axially parallel to the actuation shaft 12 and which is disposed within a bore 36 of the insert member 6.

At the outer or protruding end 32 of the bushing or sleeve 28 there is also secured coaxially with respect to the axis of rotation 4 of the actuation shaft 12 a hexagonal or hexagon head 38 which is in driving connection with and thus can be appropriately rotated by, for instance a complementary hexagonal or hexagon key or the like of, for instance, an electrically operated device or actuator 11 for actuation of the actuation shaft 12, and specifically, for rotation or pivoting of such actuation shaft 12 in both possible directions of rotation within the previously discussed angular range defined between the first stop or impact member 34 and the second stop or impact member 35. The hexagonal key or equivalent structure can also be manually operated, and if necessary the actuation also can be accomplished, for instance, by a suitable forked or bifurcated key or equivalent actuating tool.

Having now had the benefit of the previous detailed description of the arresting or locking apparatus 1, its mode of operation will now be considered and explained in greater detail:

In order to release a previously accomplished locking or arresting operation, the actuation shaft 12 of the clamping device 10 is rotated in a simple fashion with the aid of the device or actuator 11 in counter-clockwise direction until the pin or pin member 31 abuts the second stop or impact member 35 (see also FIG. 3). Upon releasing the clamping jaw members or jaws 8 and 9 from their clamping position and placement thereof in their released position the following occurs:

During the rotation of the actuation shaft 12 the cylindrical shaft portion or section 23 is moved towards the clamping jaw member 8. As a result, there is eliminated the axial play or mobility, which is provided to achieve a positive clamping action, between the cylindrical shaft portion or section 23 and the clamping jaw member 8 and such clamping jaw member 8 is successively moved against the action of the spring force of the plate springs or spring members 30. Consequently, the structural length of the package of plate springs 30 is reduced and the spring pressure somewhat increases, however so slightly that the additional actuation moment is negligible, for instance in the assumed case the actuation moment exerted by the electrical drive of the electrically operated device or actuator 11. The axial displacement of the clamping device 10 is thus practically eliminated, the clamping jaw members 8 and 9 now bear respectively at the insert member 6 and at the housing or housing part 2. Hence, there is ensured for a (contact-free) free-running or free-wheeling of the ring member 14 between both of the clamping jaw members 8 and 9. In the open condition, the spread apart clamping jaw members 8 and 9 are axially positioned in the bearing or support arrangement so that there is ensured for a free play with respect to the ring member or annulus 14 which is to be blocked in its position.

After having accomplished the setting or adjustment of the here assumed firing device or gun with the aid of the hand wheel 3 in the desired position, here then the elevation position of the firing device, there is performed the locking and fixation of the momentarily set or adjusted position in that the hand wheel 3 is fixedly connected by means of the ring member 14 and the clamping jaw members 8 and 9 with a part or housing of the firing device which is stationary in relation to the hand wheel 3.

For performing the locking or arresting operation, the actuation shaft 12 of the clamping device 10 is now rotated with the aid of the device or actuator 11 in clockwise direction until the pin 31 strikes against the first stop or impact member 34 as shown in FIG. 3. As a result, there is exerted a tensile or tractive force upon the clamping jaw member 9 which, for instance exceeds 1,000 Newtons against the force of the pre-biased plate springs 30 effective upon the clamping jaw member 8 and by means of the thread connection provided by the aforedescribed elements 24 and 25 between the actuation shaft 12 and the clamping jaw member 9. This tensile force brings about a fixed frictional connection or form-locking connection, on the one hand, between both of the clamping jaw members 8 and 9 which are thus defined in their axial position and, on the other hand, the ring member or annulus 14 which is fixedly connected with the hand wheel 3. As a result, the hand wheel 3 is locked and fixed in the desired manner in its desired position. The play which is present in the locking or arresting apparatus 1 is here assumed, for purposes of discussion to be in the order of magnitude of, for instance, 0.1 mm. The transmission of this play to the hand wheel 3 of the herein discussed firing device or gun, then corresponds to an angle of approximately 0.1°, and this angular play is reduced by the transmission to the elevation coordinate (according to this example of 1:140) to approximately 2.3" (seconds), this value also being negligible for precise position measurements.

The invention is not limited to the exemplary embodiment which has been explained heretofore in conjunction with the drawings, rather details of the described exemplary embodiment can be varied without departing from the teachings and scope of the invention.

In particular, the herein depicted and described solution of a locking or arresting apparatus is applicable for many different fields of application, especially when there is utilized the considered electrical actuation. Thus, for instance, a shaft of a mechanism, for instance a gearing or transmission, can be positionally fixed in the described manner in order to directly or purposely realize an almost play free arresting of such shaft and by means of a possibly transmission stepped-up operational path an arresting of the shaft with negligible play (essentially play-free). Additionally, the locking or arresting apparatus is essentially free of maintenance and operationally reliable to a high degree, so that it also can be used at locations where otherwise for reasons of safety such locking or arresting mechanisms had to be arranged with a great deal of difficulty at other freely accessible locations of an associated device.

While there are shown and described present preferred embodiments of the invention, it is to be distinctly understood that the invention is not limited thereto, but may be otherwise variously embodied and practiced within the scope of the following claims.

What I claim is:

1. A locking apparatus for securing an adjusted position at a device, comprising:

housing means provided for said device;

an adjustment mechanism having an axis of rotation;

said adjustment mechanism comprising a substantially cylindrical-shaped ring member arranged substantially concentrically with respect to the axis of rotation of the adjustment mechanism;

a clamping device cooperating with said substantially cylindrical-shaped ring member;

said clamping device comprising a pair of clamping jaw members;

said clamping jaw member being capable of assuming a clamping position, in which said substantially cylindrical-shaped ring member is clamped between the pair of clamping jaw members, and a released position, in which said substantially cylindrical-shaped ring member is released from both clamping jaw members of said pair of clamping jaw members;

said clamping device containing a displaceable member which is axially displaceable relative to and in said housing means and radially displaceable with respect to said substantially cylindrical-shaped ring member;

said displaceable member containing a coupling shaft section for coupling said displaceable member via a threaded bore in a clamping jaw member of said pair of clamping jaw members to said pair of clamping jaw members for displacing both said clamping jaw members of said pair of clamping jaw members in a self-positioning manner between said clamping position and said released position relative to said substantially cylindrical-shaped ring member; and actuation means for displacing said displaceable member axially relative to and in said housing means and radially with respect to said substantially cylindrical-shaped ring member.

2. The locking apparatus as defined in claim 1, wherein:

said housing means comprises a recess;

an insert member arranged in said recess of said housing means; and said clamping device containing said two clamping jaw members being arranged at least partially in said recess.

3.

A locking apparatus for securing an adjusted position at a device, comprising:

housing means provided for said device;

an adjustment mechanism having an axis of rotation;

said adjustment mechanism comprising a substantially cylindrical-shaped ring member arranged substantially concentrically with respect to the axis of rotation of the adjustment mechanism;

a clamping device cooperating with said substantially cylindrical-shaped ring member;

said clamping device comprising a pair of clamping jaw members;

said clamping jaw members being capable of assuming a clamping position, in which said substantially cylindrical-shaped ring member is clamped between the pair of clamping jaw members, and a released position, in which said substantially cylindrical-shaped ring member is released from both clamping jaw members of said pair of clamping jaw members;

said clamping device containing a displaceable member which is axially displaceable relative to and in said housing means and radially displaceable with respect to said substantially cylindrical-shaped ring member;

said displaceable member being coupled to said pair of clamping jaw members for displacing both said clamping jaw members of said pair of clamping jaw members in a self-positioning manner between said clamping position and said released position relative to said substantially cylindrical-shaped ring member;

actuation means for displacing said displaceable member axially relative to and in said housing means and radially with respect to said substantially cylindrical-shaped ring member;

said housing means comprising a recess;

an insert member arranged in said recess of said housing means;

said clamping device containing said two clamping jaw members being arranged at least partially in said recess;

said adjustment mechanism comprising a hand wheel;

said hand wheel supporting said substantially cylindrical-shaped ring member; and said insert member being arranged within said recess of said housing means and extending toward said substantially cylindrical-shaped ring member in radially spaced relationship from said axis of rotation of the adjustment mechanism.

4. The locking apparatus as defined in claim 3, further including:

a substantially U-shaped recess means provided in said insert member for receiving said pair of clamping jaw members of said clamping device; and said pair of clamping jaw members of said clamping device being arranged in said substantially U-shaped recess means for movement to-and-fro in a lengthwise direction of said substantially U-shaped recess means such that said pair of clamping jaw members are unable to perform any lateral movement with respect to said lengthwise direction of said substantially U-shaped recess means.

5. The locking apparatus as defined in claim 4, wherein:

said substantially cylindrical-shaped ring member having curved oppositely situated sides defining an outer side and an inner side of said substantially cylindrical-shaped ring member;

one of said pair of clamping jaw members is arranged at said outer side of said substantially cylindrical-shaped ring member;

the other one of said pair of clamping jaw members is arranged at said inner side of said substantially cylindrical-shaped ring member;

said one clamping jaw member which is arranged at the outer side of said substantially cylindrical-shaped ring member possesses a concave domed contact surface adapted to the outer side of said substantially cylindrical-shaped ring member; and said other clamping jaw member which is arranged at the inner side of said substantially cylindrical-shaped ring member possesses a convex domed contact surface which is adapted to the inner side of said substantially cylindrical-shaped ring member.

6. The locking apparatus as defined in claim 5, wherein:

said displaceable member of said clamping device comprises a rotatably mounted actuation shaft;

friction bearing means for rotatably mounting said actuation shaft for selective rotational movement in opposite directions of rotation; and said actuation means being drivingly connected to said rotatably mounted actuation shaft in order to impart to said rotatably mounted actuation shaft a selective rotation in both opposite directions of rotational movement of said actuation shaft.

7. The locking apparatus as defined in claim 6, wherein:

said rotatably mounted actuation shaft comprises a substantially cylindrical shaft section provided with external thread means;

said other clamping jaw member which is arranged at the inner side of said substantially cylindrical-shaped ring member being provided with internal thread means;

said external thread means of said cylindrical shaft section meshing with said internal thread means of said other clamping member arranged at the inner side of said substantially cylindrical-shaped ring member;

said one clamping jaw member which is arranged at the outer side of said substantially cylindrical-shaped ring member comprises bore means; and said rotatably mounted actuation shaft extending through said bore means of said one clamping jaw member.

8. The locking apparatus as defined in claim 7, further including:

plate spring means mounted on said actuation shaft at one side of said one clamping jaw member and which side is remote from the outer side of said substantially cylindrical-shaped ring member;

a support ring provided for said plate spring means; and a bushing mounted on said rotatably mounted actuation shaft and fixedly non-rotatably connected with said rotatably mounted actuation shaft.

9. The locking apparatus as defined in claim 8, wherein:

said bushing has an end protruding out of said insert member;

a pin member provided for said protruding end of said bushing;

said pin member extending transversely with respect to longitudinal axis of said bushing;

said pin member having a pin end portion which protrudes beyond an outer surface of said bushing;

said insert member having a substantially circular-shaped recess;

said protruding pin end portion being rotatably arranged in said substantially circular -shaped recess of said insert member such that upon actuation of said clamping device said protruding pin end portion selectively performs a rotational movement in said substantially circular-shaped recess of said insert member in each of opposite directions of rotation of said protruding pin end portion throughout a predetermined angular range.

10. The locking apparatus as defined in claim 9, further including:

first stop means cooperating with said protruding pin end portion of said pin member;

second stop means cooperating with said protruding pin end portion of said pin member;

said first and second stop means being arranged in said substantially circular-shaped recess of said insert member; and said first and second stop means delimiting said predetermined angular range of said rotational movement of said protruding pin end portion of said pin member.

11. A locking apparatus for securing an adjusted position, comprising:

housing means;

an adjustment mechanism having an axis of rotation;

said adjustment mechanism comprising a component having oppositely situated sides;

a clamping device cooperating with said oppositely situated sides of said component;

said clamping device comprising a pair of clamping jaw members;

each one of said clamping jaw members being arranged to contactingly engage a respective one of said oppositely situated sides of said component;

said clamping jaw members being displaceable between a clamping position, in which each said clamping jaw member contactingly engages the respective side of said component and the component is clampingly engaged by said pair of clamping jaw members, and a released position, in which each said clamping jaw member is disengaged from the respective side of said component and the component is released from said pair of clamping jaw members;

said clamping device containing a displaceable member which is axially displaceable relative to and in said housing means and radially displaceable with respect to said component;

said axially displaceable member containing a coupling shaft section for coupling said axially displaceable member via a threaded bore in a clamping jaw member of said pair of clamping jaw members to both said clamping jaw members for displacing both said clamping jaw members in a self-positioning manner between said clamping position and said released position; and actuation means for displacing said displaceable member axially relative to said housing means and radially with respect to said component.

* * * * *